United States Patent [19]

Iwasa et al.

[11] Patent Number: 4,875,984

[45] Date of Patent: Oct. 24, 1989

[54] METHOD FOR MANUFACTURING ELECTROLYTICALLY CHROMATED STEEL SHEET

[75] Inventors: Hiroki Iwasa; Toyofumi Watanabe; Hirohide Furuya, all of Tokyo, Japan

[73] Assignee: NKK Corporation, Tokyo, Japan

[21] Appl. No.: 309,683

[22] Filed: Feb. 10, 1989

[30] Foreign Application Priority Data

Feb. 27, 1988 [JP] Japan ..... 63-45419

[51] Int. Cl.[4] ..... C25D 11/38

[52] U.S. Cl. ..... 204/56.1

[58] Field of Search ..... 204/41, 42, 56.1

[56] References Cited

FOREIGN PATENT DOCUMENTS 62-54096 3/1987 Japan .

OTHER PUBLICATIONS

Metal Surface Technology, A Journal of the Metal Finishing Society of Japan, vol. 35, No. 7, pp. 34–38, issued on July 1, 1984.

*Primary Examiner*—T. M. Tufariello

*Attorney, Agent, or Firm*—Frishauf, Holtz, Goodman & Woodward

[57] ABSTRACT

A method for manufacturing an electrolytically chromated steel sheet, comprising the steps of: subjecting a steel sheet to an anodic electrolytic treatment with a quantity of electricity of from 0.3 to 30 coulomb/dm$^2$ in an acidic electrolyte containing at least one of chromic anhydride, chromate and bichromate, to form a hydrated chromium oxide film having numerous holes and numerous thin portions over the entire area of at least one surface of the steel sheet; and then subjecting the anodically treated steel sheet to a cathodic electrolytic chromate treatment in an acidic electrolytic chromating solution to form on the at least one surface of the steel sheet a chromate film comprising a metallic chromium layer as a lower layer having thereon numerous granular projections, and a hydrated chromium oxide layer as an upper layer. The electrolytically chromated steel sheet manufactured in accordance with the method of the present invention has excellent secondary paint adhesion and weldability, and has a satisfactory surface hue.

3 Claims, 1 Drawing Sheet

METHOD FOR MANUFACTURING ELECTROLYTICALLY CHROMATED STEEL SHEET

REFERENCE TO PATENTS, APPLICATIONS AND PUBLICATIONS PERTINENT TO THE INVENTION

As far as we know, there are available the following prior art documents pertinent to the present invention:

(1) Japanese patent provisional publication No. 62-54,096 dated Mar. 9, 1987; and (2) "Metal Surface Technology", a journal of the Metal Finishing Society of Japan, vol. 35, No. 7, pages 34–38, issued on July 1, 1984.

The contents of the prior arts disclosed in the above-mentioned prior art documents will be discussed hereafter under the heading of the "BACKGROUND OF THE INVENTION."

FIELD OF THE INVENTION

The present invention relates to a method for manufacturing an electrolytically chromated steel sheet having on at least one surface of a steel sheet a chromating film comprising a metallic chromium layer as a lower layer and a hydrated chromium oxide layer as an upper layer formed on the metallic chromium layer.

BACKGROUND OF THE INVENTION

There is known an electrolytically chromated steel sheet having on at least one surface of a steel sheet a chromate film comprising a metallic chromium layer as a lower layer and a hydrated chromium oxide layer as an upper layer formed on the metallic chromium layer. The metallic chromium layer as the lower layer usually has a thickness of from about 0.005 to about 0.03 μm, and the hydrated chromium oxide layer as the upper layer usually has a thickness of from about 0.01 to about 0.04 μm.

Methods for manufacturing the above-mentioned electrolytically chromated steel sheet are broadly divided into the following two classes:

(1) One-step method:

This method comprises subjecting a steel sheet to a cathodic electrolytic chromate treatment in an acidic electrolytic chromating solution comprising at least one of chromic anhydride, chromate and bichromate as a main agent, and at least one of sulfuric acid, sulfate and fluorine compound as an assistant agent, to form on at least one surface of the steel sheet simultaneously a metallic chromium layer as a lower layer and a hydrated chromium oxide layer as an upper layer.

(2) Two-step method:

This method comprises subjecting a steel sheet to a first cathodic electrolytic chromate treatment in an acidic electrolytic chromating solution comprising at least one of chromic anhydride, chromate and bichromate as a main agent, and at least one of sulfuric acid, sulfate and fluorine compound as an assistant agent, to form on at least one surface of the steel sheet simultaneously a metallic chromium layer as a lower layer and a hydrated chromium oxide layer as an upper layer (a first step); and then, after removing the thus formed hydrated chromium oxide layer through dissolution, subjecting the steel sheet from which the hydrated chromium oxide layer has been removed to a second cathodic electrolytic chromate treatment in another acidic electrolytic chromating solution comprising at least one of chromic anhydride, chromate and bichromate as a main agent, to form again a new hydrated chromium oxide layer as an upper layer on the metallic chromium layer as the lower layer (a second step).

The electrolytically chromated steel sheet manufactured as described above is excellent not only in a corrosion resistance but also in a paint adhesion between the chromating film and a paint film formed thereon, i.e., a primary paint adhesion, and is less expensive as compared with a tin-plated steel sheet. The electrolytically chromated steel sheet is therefore widely used in place of the tin-plated steel sheet as a material for cans such as a food can, a pail can, an 18-l can and an oil can. A soldered can made of the tin-plated steel sheet, which comprises an upper lid, a bottom lid and a drum of which the seam is soldered, has been used as a can for a soft drink. In replacement of the soldered can, recently, a cemented can made of the electrolytically chromated steel sheet, which comprises an upper lid, a bottom lid, and a drum of which the seam is cemented with a nylon adhesive, has come to be employed. The cemented can made of the electrolytically chromated steel sheet has become popular for the following reasons: The cemented can made of the electrolytically chromated steel sheet is less expensive than the soldered can made of the tin-plated steel sheet. In addition, when the cemented can is filled with a carbonated drink, for example, the carbonated drink never leaks from the seam and the degree of vacuum in the can never decreases because of the excellent primary paint adhesion of the electrolytically chromated steel sheet.

A cemented can is usually manufactured by a process comprising: forming a paint film on each of the chromating films on the both surfaces of a electrolytically chromated steel sheet having prescribed dimensions, then forming the electrolytically chromated steel sheet having the paint films thereon into a drum of can, cementing the seam of the overlapping portions of the drum of can with an adhesive, and then, securing an upper lid and a bottom lid to the drum with the thus cemented seam.

A high-temperature content such as a fruit juice heated to a temperature of from 90° to 100° C. for sterilization may be charged into the thus manufactured cemented can made of the electrolytically chromated steel sheet, or the above-mentioned cemented can filled with a content may be heated by means of pressurized steam at a temperature of about 130° C. for sterilization of the content. However, when filling the cemented can made of the electrolytically chromated steel sheet with the high-temperature content, or when heating the cemented can filled with the content by means of high-temperature steam, paint adhesion between the chromating film and the paint film formed thereon, i.e., secondary paint adhesion in high-temperature and high-humidity environment decreases.

As a result, the seam of the can suffering from the most serious stress is broken, and the content of the can leaks out through the broken portion of the seam, or the degree of vacuum in the can is reduced. This deterioration of the secondary paint adhesion is attributable to the fact that water penetrates between the chromating film on the seam portion of the drum and the paint film formed thereon and reduces adhesion between these films. A higher penetrating rate of water therefore leads to more serious deterioration of the secondary paint adhesion. The electrolytically chromated steel sheet is usually manufactured, as described above, by the application of any of the one-step method and the two-step method. None of these methods can prevent deterioration of the secondary paint adhesion.

The electrolytically chromated steel sheet is used also as a material for a two-piece can comprising a cup-shaped can body and an upper lid, in addition to the application mentioned above for a cemented can. However, the electrolytically chromated steel sheet is not used so popularly as a material for a welded can comprising an upper lid, a lower lid and a drum having a seam welded by an electric resistance welding, because of a low weldability of the electrolytically chromated steel sheet. However, demand for the welded can is increasing because of the high strength of the seam thereof. For the purpose of using the electrolytically chromated steel sheet as a material for the welded can, therefore, improvement of weldability thereof is now demanded.

The electrolytically chromated steel sheet has a low weldability for the following reasons: Both the metallic chromium layer as the lower layer and the hydrated chromium oxide layer as the upper layer, which form the chromating film, are not thermally conductive, and furthermore, the hydrated chromium oxide layer as the upper layer is not electrically conductive. Therefore, when welding the seam of the overlapping portions of the cylinder of the can by electric resistance welding, the hydrated chromium oxide layer as the upper layer becomes an electrically insulating layer, thus increasing the value of contact resistance at the portion to be welded. The value of contact resistance serves as a criterion for determining whether excessive electric current locally flows or not during welding. More specifically, when the value of contact resistance is high, excessive electricity tends to locally flow because of the narrow path for welding electric current. The electrolytically chromated steel sheet has a value of contact resistance within the range of from $10^2$ to $10^5$ $\mu\Omega/mm^2$, which is far higher than that of the other surface-treated steel sheets for the welded can. Therefore, when welding the electrolytically chromated steel sheet by the electric resistance welding, the value of welding current is low immediately after the start of welding, and after the lapse of a certain period of time, reaches a prescribed value of welding current. As a result, the electrolytically chromated steel sheet locally generates heat at the beginning of welding to produce a splash, and defects such as blowholes are produced at the welded joint. When welding the electrolytically chromated steel sheet, therefore, it has conventionally been necessary to remove the chromating film at the portion to be welded through grinding, for example, which has required much time and labor.

As a means to solve the above-mentioned problems of the electrolytically chromated steel sheet, i.e., to prevent deterioration of the secondary paint adhesion and the weldability, a known method comprises forming numerous granular projections over the entire surface of the metallic chromium layer as the lower layer of the chromating film. The electrolytically chromated steel sheet having the chromating film which includes the metallic chromium layer as a lower layer provided with numerous granular projections over the entire surface thereof, has the following characteristics:

(1) When the above-mentioned electrolytically chromated steel sheet is used as a material for a cemented can in which a seam of the drum is cemented with an adhesive, penetration of water between the chromating film and the paint film formed thereon is prevented. The secondary paint adhesion is accordingly improved.

(2) When the above-mentioned electrolytically chromated steel sheet is used as a material for a welded can in which a seam of the drum is welded by electric resistance welding, the hydrated chromium oxide layer as the upper layer, which is not electrically conductive, is broken during the electric resistance welding by the numerous granular projections formed on the entire surface of the metallic chromium layer as the lower layer, thus reducing the value of contact resistance of the portion to be welded and improving weldability.

For the purpose of forming the numerous granular projections over the entire surface of the metallic chromium layer as the lower layer of the chromating film, the following methods are known:

(1) A method for manufacturing an electrolytically chromated steel sheet, disclosed in Japanese patent provisional publication No. 62–54,096 dated Mar. 9, 19867, which comprises: subjecting a steel sheet to an anodic electrolytic treatment at least once in the middle of a plurality of runs of application of a cathodic electrolytic chromate treatment to the steel sheet so as to form numerous granular projections on the entire surface of the metallic chromium layer of the chromating film (hereinafter referred to as the "Prior Art 1").

(2) A paper under the title of "the effect of crystallographic orientation on the growth of electrodeposited metallic chromium", appearing in the "Metal Surface Technology", a journal of the Metal Finishing Society of Japan, Vol. 35, No. 7, pages 34–38, issued on July 1, 1984, which reveals the fact that, when a steel sheet is subjected to a plurality of runs of cathodic electrolytic chromate treatment intermittently in an acidic electrolytic chromating solution, numerous granular projections are formed over the entire surface of the metallic chromium layer of the chromating film formed on at least one surface of the steel sheet (hereinafter referred to as the "Prior Art 2").

The above-mentioned Prior Art 1 has the following problems:

(1) When the steel sheet is subjected to the anodic electrolytic treatment in the middle of a plurality of runs of application of the cathodic electrolytic chromate treatment to the steel sheet, numerous granular projections are formed over the entire surface of the metallic chromium layer of the chromating film, but the thus formed granular projections have a very small average particle size of up to about 0.05 $\mu$m. As a result, reflected light causes diffraction and interference in the metallic chromium layer. This makes the surface of the electrolytically chromated steel sheet look black or brown, thus seriously impairing the surface hue.

(2) Production of hydrogen gas upon precipitation of metallic chromium usually results in a low precipitation efficiency of about 20% of metallic chromium in the cathodic electrolytic chromate treatment. From the point of view of the consumption of electricity required for the cathodic electrolytic chromate treatment and productivity of the process, therefore, there is a demand for improvement of precipitation efficiency of metallic chromium. However, if the steel sheet is subjected to the anodic electrolytic treatment in the middle of a plurality of runs of application of the cathodic electrolytic chromate treatment to the steel sheet, part of the metallic chromium layer thus formed is dissolved by the anodic electrolytic treatment, thus seriously reducing the precipitation efficiency of metallic chromium.

The above-mentioned Prior Art 2 has the following problems: in order to form numerous granular projections over the entire surface of the metallic chromium layer of the chromating film formed on at least one surface of the steel sheet through intermittent application of the plurality of runs of the cathodic electrolytic chromate treatment, it is necessary to provide a long non-energizing period of time between the plurality of runs of the cathodic electrolytic chromate treatment, or to use an extremely low travelling speed of the steel sheet for the plurality of runs of the cathodic electrolytic chromate treatment. As a result, it is necessary to provide large-scale manufacturing facilities of the electrolytically chromated steel sheet, or the manufacturing efficiency is largely reduced.

Under such circumstances, there is a strong demand for development of a method for efficiently manufacturing an electrolytically chromated steel sheet excellent in secondary paint adhesion and weldability and having a satisfactory surface hue, but such a method has not as yet been proposed.

SUMMARY OF THE INVENTION

An object of the present invention is therefore to provide a method for efficiently manufacturing an electrolytically chromated steel sheet excellent in secondary paint adhesion and a weldability and having a satisfactory surface hue.

In accordance with one of the features of the present invention, there is provided a method for manufacturing an electrolytically chromated steel sheet, characterized by comprising the steps of:

subjecting a steel sheet to an anodic electrolytic treatment with a quantity of electricity within the range of from0.3 to 30 coulomb/dm$^2$ in an acidic electrolyte containing at least one of chromic anhydride, chromate and bichromate, to form a hydrated chromium oxide film having numerous holes and numerous thin portions over the entire area of at least one surface of said steel sheet; and then subjecting said steel sheet applied with said anodic electrolytic treatment to a cathodic electrolytic chromate treatment in an acidic electrolytic chromating solution to form on said at least one surface of said steel sheet a chromate film comprising a metallic chromium layer as a lower layer having thereon numerous granular projections corresponding to said numerous holes and said numerous thin portions, and a hydrated chromium oxide layer as an upper layer formed on said metallic chromium layer.

DETAILED DESCRIPTION OF PREFERRED EMBODIMENTS

Figure 1:
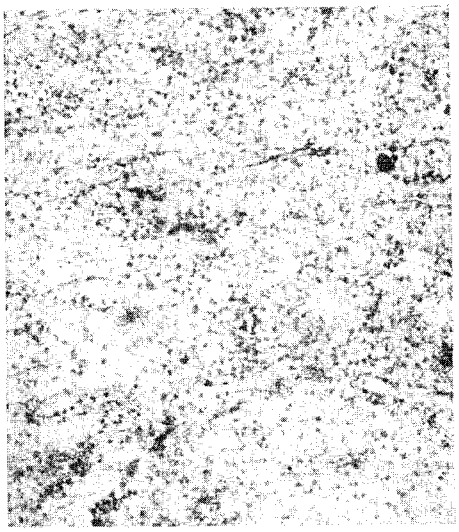
FIG. 1 is an electron micrograph (10,000 magnifications) illustrating the structure of the metallic chromium layer of the chromate film in the sample of the present invention No. 1 prepared in accordance with the method of the present invention.

From the above-mentioned point of view, extensive studies were carried out to develop a method for efficiently manufacturing an electrolytically chromated steel sheet excellent in secondary paint adhesion and weldability and having a satisfactory surface hue. As a result, the following findings were obtained:

(1) Basic points of formation of granular projections on the surface of the metallic chromium layer of the chromating film lie in holes and thin portions existing in the hydrated chromium oxide layer formed on at least one surface of the steel sheet, and metallic chromium is precipitated from the above-mentioned hydrated chromium oxide layer. A hydrated chromium oxide layer formed through a conventional cathodic electrolytic chromate treatment contains only a limited number of holes and thin portions. Even by subjecting the steel sheet intermittently to a plurality of runs of the cathodic electrolytic chromate treatment during a short period of time, it is impossible to form numerous holes and numerous thin portions in the hydrated chromium oxide layer. Numerous granular projections cannot consequently be formed over the entire surface of the metallic chromium layer. In order to form numerous granular projections over the entire surface of the metallic chromium layer, therefore, it is necessary to provide a long nonenergizing period of time between the plurality of runs of the cathodic electrolytic chromate treatment, or to use a very low travelling speed of the steel sheet for the plurality of runs of the cathodic electrolytic chromate treatment.

(2) By subjecting the steel sheet to an anodic electrolytic treatment in the middle of a plurality of runs of application of the cathodic electrolytic chromate treatment to the steel sheet, numerous holes and numerous thin portions are produced in the hydrated chromium oxide layer formed by the cathodic electrolytic chromate treatment, and at the same time, a thin chromium oxide film is produced on the surface of the metallic chromium layer. This thin chromium oxide film on the surface of the metallic chromium layer and the hydrated chromium oxide layer formed thereon form a composite hydrated chromium oxide. The thus produced composite hydrated chromium oxide reduces the particle size of the granular projections formed on the surface of the metallic chromium layer to a very small average value of up to 0.05 μm.

(3) By subjecting the steel sheet to an anodic electrolytic treatment in an acidic electrolyte containing at least one of chromic anhydride, chromate and bichromate, a thin hydrated chromium oxide film having a deposit weight of up to 2 mg/m$^2$ is formed, which is provided with numerous holes and numerous thin portions over the entire area of at least one surface of the steel sheet. Since no metallic chromium layer is formed on the surface of the steel sheet by the above-mentioned anodic electrolytic treatment, the above-mentioned composite hydrated chromium oxide is not formed either, which largely reduces the particle size of the granular projections. By subjecting the steel sheet applied with a anodic electrolytic treatment to the cathodic electrolytic chromate treatment, therefore, a metallic chromium layer is formed, which has numerous granular projections having a relatively large average particle size of about 0.1 μm, corresponding to the numerous holes and the numerous thin portions formed in the hydrated chromium oxide film mentioned above. If the granular projections formed on the surface of the chromium layer have an average particle size of about 0.1 μm, the surface of the electrolytically chromated steel sheet having such a metallic chromium layer never looks black or brown, thus improving the surface hue.

The present invention was developed on the basis of the above-mentioned findings. The method for manufacturing an electrolytically chromated steel sheet of the present invention is described below in detail.

In the present invention, a steel sheet is subjected to an anodic electrolytic treatment with a quantity of electricity within the range of from 0.3 to 30 coulomb/dm$^2$ in an acidic electrolyte containing at least one of chromic anhydride, chromate and bichromate, to form a hydrated chromium oxide film having numerous holes and numerous thin portions over the entire area of at least one surface of the steel sheet. The steel sheet thus applied with the anodic electrolytic treatment is then subjected to a cathodic electrolytic chromate treatment to form on at least one surface of the steel sheet a chromating film comprising a metallic chromium layer as a lower layer having thereon numerous granular projections having a relatively large average particle size of about 0.1 μm, which correspond to the numerous holes and the numerous thin portions mentioned above, and a hydrated chromium oxide layer as an upper layer formed on the above-mentioned metallic chromium layer.

In the present invention, the quantity of electricity for the anodic electrolytic treatment should be within the range of from 0.3 to 30 coulomb/dm$^2$. With a quantity of electricity of under 0.3 coulomb/dm$^2$, a desired hydrated chromium oxide film cannot be formed over the entire area of at least one surface of the steel sheet. With a quantity of electricity of over 30 coulomb/dm$^2$, on the other hand, no particular improvement is available in the above-mentioned effect, resulting in an uneconomical consumption.

The cathodic electrolytic chromate treatment to be applied to the steel sheet, following the anodic electrolytic treatment, may be carried out in accordance with any of the above-mentioned conventional one-step and two-step methods in an acidic electrolytic chromating solution having the conventional composition. Irrespective of which of these methods is employed for the cathodic electrolytic chromate treatment, it is possible to form on at least one surface of the steel sheet a chromating film comprising a metallic chromium layer as a lower layer having thereon numerous granular projections, and a hydrated chromium oxide layer as an upper layer formed on the metallic chromium layer.

By further additionally adding at least one of sulfuric acid ion and fluorine ion to the acidic electrolyte containing at least one of chromic anhydride, chromate and bichromate for the application of the anodic electrolytic treatment to the steel sheet, it is possible to more efficiently carry out formation of the hydrated chromium oxide film as mentioned above on at least one surface of the steel sheet. The content of at least one of sulfuric acid ion and fluorine ion should be within the range of from 0.1 to 5 wt. % relative to chromium in the acidic electrolyte. With a content of at least one of sulfuric acid ion and fluorine ion of under 0.1 wt. %, a desired effect cannot be obtained. With this content of over 5 wt. %, on the other hand, no particular improvement is available in the above-mentioned effect, resulting in an uneconomical consumption.

In the present invention, the anodic electrolytic treatment carried out prior to the cathodic electrolytic chromate treatment activates the surface of the steel sheet. Therefore, pickling which is usually applied to the steel sheet prior to a cathodic electrolytic chromate treatment may be omitted in the present invention. It is needless to mention that, prior to the anodic electrolytic treatment, the steel sheet may be subjected to pickling. Water rinsing may be or need not be applied to the steel sheet in the interval between the anodic electrolytic treatment and the cathodic electrolytic chromate treatment.

According to the method of the present invention, it is possible to form numerous granular projections having a relatively large average particle size of about 0.1 μm over the entire surface of the metallic chromium layer of the chromating film formed on at least one surface of the steel sheet. Therefore, the electrolytically chromated steel sheet manufactured in accordance with the method of the present invention is excellent in secondary paint adhesion and a weldability, and furthermore, because the granular projections of the metallic chromium layer have a relatively large average particle size of about 0.1 μm, the surface of the electrolytically chromated steel sheet never looks black or brown and has a satisfactory surface hue. In addition, according to the method of the present invention, the electrolytic precipitation efficiency of metallic chromium is improved by at least 5% as compared with the case where, prior to a cathodic electrolytic chromate treatment, pickling is carried out without an anodic electrolytic treatment, as in the Prior Arts 1 and 2 described previously. This is attributable to the synergistic effect of the facts that, in the present invention, the anodic electrolytic treatment further activates the surface of the steel sheet, and that the cathodic electrolytic chromate treatment causes metallic chromium to precipitate into crystals which form the granular projections.

Now, the method of the present invention is described in more detail by means of examples while comparing with examples for comparison.

EXAMPLE

Steel sheets were subjected to an anodic electrolytic treatment and a cathodic electrolytic chromate treatment in accordance with the method of the present invention to prepare samples of the present invention Nos. 1 to 9 as follows:

I. Sample of the present invention No. 1

A cold-rolled steel sheet having a thickness of 0.22 mm was electrolytically degreased in an electrolyte containing 30 g/l caustic soda, and then water-rinsed. Then, the electrolytically degreased cold-rolled steel sheet was subjected to an anodic electrolytic treatment under conditions shown in (A) below. Subsequently, the cold-rolled steel sheet thus applied with the anodic electrolytic treatment was subjected to a cathodic electrolytic chromate treatment under conditions shown in (B) below, then water-rinsed and dried to prepare the sample of the present invention No. 1.

(A) Anodic electrolytic treatment conditions

| | |
|---|---|
| (1) Composition of electrolyte | |
| Chromic anhydride | 100 g/l, |
| Sulfuric acid | 1 g/l, |
| Content ratio of sulfuric acid | |

-continued

| | |
|---|---|
| ion relative to chromium | 1.9 wt. %, |
| (2) Temperature of electrolyte | 25° C., |
| (3) Electric current density | 10 A/dm$^2$, |
| (4) Electrolytic treatment time | 0.3 seconds, |
| (5) Quantity of electricity | 3 coulomb/dm$^2$. |

(B) Cathodic electrolytic chromate treatment conditions

| | |
|---|---|
| (1) Method for electrolysis | one-step method, |
| (2) Composition of electrolyte | |
| Chromic anhydride | 175 g/l, |
| Sodium silicofluoride | 5 g/l, |
| Sodium sulfate | 0.9 g/l, |
| (3) Temperature of electrolyte | 40° C., |
| (4) Number of runs of electrolysis | 4 runs, |
| (5) Electric current density | 40 A/dm$^2$, |
| (6) Electrolytic treatment time | 0.3 seconds per run, |
| (7) Non-energizing time | 0.3 seconds per run. |

II. Sample of the present invention No. 2

A cold-rolled steel sheet having a thickness of 0.22 mm was electrolytically degreased in an electrolyte containing 30 g/l caustic soda, then water-rinsed, then pickled in an electrolyte containing 5 g/l sulfuric acid, and then water-rinsed. The cold-rolled steel sheet thus electrolytically degreased and then pickled was subjected to an anodic electrolytic treatment and a cathodic electrolytic chromate treatment under the same conditions as those for the sample of the present invention No. 1, then water-rinsed and dried to prepare the sample of the present invention No. 2.

III. Sample of the present invention No. 3

A cold-rolled steel sheet having the same thickness as the sample of the present invention No. 2, which has been electrolytically degreased and then pickled under the same conditions as those for the sample of the present invention No. 2, was subjected to an anodic electrolytic treatment under conditions shown in (A) below. Then, the cold-rolled steel sheet thus applied with the anodic electrolytic treatment was subjected to a cathodic electrolytic chromate treatment under conditions shown in (B) below, water-rinsed and dried to prepare the sample of the present invention No. 3.

(A) Anodic electrolytic treatment conditions

| | |
|---|---|
| (1) Composition of electrolyte | |
| chromic anhydride | 100 g/l, |
| (2) Temperature of electrolyte | 25° C., |
| (3) Electric current density | 10 A/dm$^2$ |
| (4) Electrolytic treatment time | 0.3 seconds, |
| (5) Quantity of electricity | 3 coulomb/dm$^2$. |

(B) Cathodic electrolytic chromate treatment conditions

Same as those for the sample of the present invention No. 1.

IV. Sample of the present invention No. 4

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) below. Then, the cold-rolled steel sheet thus applied with the anodic electrolytic treatment was subjected to a cathodic electrolytic chromate treatment under conditions shown in (B) below, water-rinsed and dried to prepare the sample of the present invention No. 4.

(A) Anodic electrolytic treatment conditions

| | |
|---|---|
| (1) Composition of electrolyte | |
| Chromic anhydride | 50 g/l, |
| Ammonium fluoride | 1 g/l, |
| Content ratio of fluorine ion relative to Chromium | 1.9 wt. %, |
| (2) Temperature of electrolyte | 35° C., |
| (3) Electric current density | 20 A/dm$^2$, |
| (4) Electrolytic treatment time | 0.4 seconds, |
| (5) Quantity of electricity | 8 coulomb/dm$^2$. |

(B) Cathodic electrolytic chromate treatment conditions

| | |
|---|---|
| (1) Method for electrolysis | one-step method, |
| (2) Composition of electrolyte | |
| Chromic anhydride | 100 g/l, |
| Sodium thiocyanate | 0.5 g/l, |
| Borofluoric acid | 0.9 g/l, |
| (3) Temperature of electrolyte | 45° C., |
| (4) Number of runs of electrolysis | 4 runs, |
| (5) Electric current density | 30 A/dm$^2$, |
| (6) Electrolytic treatment time per run, | 0.4 seconds |
| (7) Non-energizing time per run. | 0.3 seconds |

V. Sample of the present invention No. 5

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) below. Then, the cold-rolled steel sheet thus applied with the anodic electrolytic treatment was subjected to a cathodic electrolytic chromate treatment under conditions shown in (B) below, water-rinsed and dried to prepare the sample of the present invention No. 5.

(A) Anodic electrolytic treatment conditions

| | |
|---|---|
| (1) Composition of electrolyte | |
| Sodium bichromate | 60 g/l, |
| Sodium sulfate | 0.4 g/l, |
| Content ratio of sulfuric acid ion relative to chromium | 2.2 wt. %, |
| (2) Temperature of electolyte | 50° C., |
| (3) Electric current density | 5 A/dm$^2$, |
| (4) Electrolytic treatment time | 0.4 seconds, |
| (5) Quantity of electricity | 2 coulomb/dm$^2$ |

(B) Cathodic electrolytic chromate treatment conditions

| | |
|---|---|
| (1) Method for electrolysis | one-step method, |
| (2) Composition of electrolyte | |

-continued

| | |
|---|---|
| Chromic anhydride | 150 g/l, |
| Sodium silicofluoride | 3 g/l, |
| Sulfuric acid | 0.9 g/l, |
| (3) Temperature of electrolyte | 45° C., |
| (4) Number of runs of electrolysis | 2 runs, |
| (5) Electric current density | 50 A/dm$^2$, |
| (6) Electrolytic treatment time | 0.4 seconds per run, |
| (7) Non-energizing time | 0.3 seconds. |

IV. Sample of the present invention No. 6

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) below. Then, the cold-rolled steel sheet thus applied with the anodic electrolytic treatment was subjected to a cathodic electrolytic chromate treatment under conditions shown in (B) below, then water-rinsed and dried to prepare the sample of the present invention No. 6.

(A) Anodic electrolytic treatment conditions

| | |
|---|---|
| (1) Composition of electrolyte | |
| Chromic anhydride | 100 g/l, |
| Sodium thiocyanate | 0.3 g/l, |
| Cryolite | 2 g/l, |
| Total content ratio of sulfuric acid ion and fluorine ion relative to chromium | 2.5 wt. % |
| (2) Temperature of electrolyte | 40° C., |
| (3) Electric current density | 10 A/dm$^2$, |
| (4) Electrolytic treatment time | 0.3 seconds, |
| (5) Quantity of electricity | 3 coulomb/dm$^2$. |

(B) Cathodic electrolytic chromate treatment conditions

| | |
|---|---|
| (1) Method for electrolysis | |
| (2) Composition of electrolyte | |
| Chromic anhydride | 175 g/l, |
| Sodium silicofluoride | 5 g/l, |
| Sodium sulfate | 0.9 g/l, |
| (3) Temperature of electrolyte | 40° C., |
| (4) Number of runs of electrolysis | single run, |
| (5) Electric current density | 30 A/dm$^2$, |
| (6) Electrolytic treatment time | 1.5 seconds |

VII. Sample of the present invention No. 7

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) blow. Then, the cold-rolled steel sheet thus applied with the anodic electrolytic treatment was subjected to a cathodic electrolytic chromate treatment under conditions shown in (B) below, then water-rinsed and dried to prepare the sample of the present invention No. 7.

(A) Anodic electrolytic treatment conditions

| | |
|---|---|
| (1) Composition of electrolyte | |

-continued

| | |
|---|---|
| Chromic anhydride | 175 g/l, |
| Sodium silicofluoride | 5 g/l, |
| Sodium sulfate | 0.9 g/l, |
| Total content ratio of sulfuric acid ion and fluorine ion relative to chromium | 3.3 wt. %, |
| (2) Temperature of electrolyte | 45° C., |
| (3) Electric current density | 10 A/dm$^2$, |
| (4) Electrolytic treatment time | 0.3 seconds, |
| (5) Quantity of electricity | 3 coulomb/dm$^2$. |

(B) Cathodic electrolytic chromate treatment conditions

Same as those for the sample of the present invention No. 1 except for the temperature of electrolyte of 45° C..

VIII. Sample of the present invention No. 8

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) blow. Then, the cold-rolled steel sheet thus applied with the anodic electrolytic treatment was subjected to a cathodic electrolytic chromate treatment under conditions shown in (B) below, then water-rinsed and dried to prepare the sample of the present invention No. 8.

(A) Anodic electrolytic treatment conditions

| | |
|---|---|
| (1) Composition of electrolyte | |
| Chromic anhydride | 50 g/l, |
| Ammonium fluoride | 1.5 g/l, |
| Content ratio of fluorine ion relative to chromium | 3.8 wt. %, |
| (2) Temperature of electrolyte | 35° C., |
| (3) Electric current density | 30 A/dm$^2$, |
| (4) Electrolytic treatment time | 0.4 seconds, |
| (5) Quantity of electricity | 12 coulomb/dm$^2$. |

(B) Cathodic electrolytic chromate treatment conditions

| | |
|---|---|
| (1) Method for electrolysis | one-step method, |
| (2) Composition of electrolyte | |
| chromic anhydride | 50 g/l, |
| Ammonium fluoride | 1.5 g/l, |
| (3) Temperature of electrolyte | 45° C., |
| (4) Number of runs of electrolysis | 4 runs, |
| (5) Electric current density | 30 A/dm$^2$ |
| (6) Electrolytic treatment time | 0.4 seconds per run, |
| (7) Non-energizing-time | 0.3 seconds per run, |

IX. Sample of the present invention No. 9

A cold-rolled steel sheet having the same thickness as the sample of the present invention No. 1, which has been electrolytically degreased under the same conditions as those for the sample of the present invention No. 1, was subjected to an anodic electrolytic treatment under conditions shown in (A) blow. Then, the cold-rolled steel sheet thus applied with the anodic electrolytic treatment was subjected to a cathodic electrolytic chromate treatment under conditions shown in (B) below, then water-rinsed and dried to prepare the sample of the present invention No. 9.

(A) Anodic electrolytic treatment conditions

Same as those for the sample of the present invention No. 7.

(B) Cathodic electrolytic chromate treatment conditions

| | |
|---|---|
| (1) Method for electrolysis | two-step method, |
| (2) Composition of electrolyte for the first step | |
| Chromic anhydride | 175 g/l, |
| Sodium silicofluoride | 5 g/l , |
| Sodium sulfate | 0.9 g/l, |
| (3) Temperature of electrolyte for the first step | 45° C., |
| (4) Number of runs of electrolysis for the first step | 4 runs, |
| (5) Electric current density for the first step | 40 A/dm$^2$, |
| (6) Electrolytic treatment time for the first step | 0.3 seconds per run, |
| (7) Non-energizing time for the first step | 0.3 seconds per run, |
| (8) Composition of electrolyte for the second step | |
| Chromic anhydride | 50 g/l, |
| (9) Temperature of electrolyte for the second step | 45° C., |
| (10) Number of runs of electrolysis for the second step | signle run, |
| (11) Electric current density for the second step | 5 A/dm$^2$, |
| (12) Electrolytic treatment time for the second step | 0.3 seconds. |

Then, steel sheets were subjected to a cathodic electrolytic chromate treatment in accordance with the conventional method to prepare samples for comparison Nos. 1 to 8 outside the scope of the present invention, as follows:

I. Sample for comparison No. 1

The sample for comparison No. 1 outside the scope of the present invention was prepared under the same conditions as those for the sample of the present invention No. 1, except that a cold-rolled steel sheet was not subjected to an anodic electrolytic treatment and that the cold-rolled steel sheet, was subjected to a pickling treatment in an electrolyte containing 5 g/l sulfuric acid prior to application of a cathodic electrolytic chromate treatment.

II. Sample for comparison No. 2

The sample for comparison No. 2 outside the scope of the present invention was prepared under the same conditions as those for the sample of the present invention No. 1, except that a cold-rolled steel sheet was not subjected to an anodic electrolytic treatment and that the cold-rolled steel sheet was immersed for 0.3 seconds into a solution having the same chemical composition as that of the electrolyte used for the anodic electrolytic treatment of the sample of the present invention No. 1, prior to application of a cathodic electrolytic chromate treatment.

III. Sample for comparison No. 3

A cold-rolled steel sheet having the same thickness as the sample of the present invention No. 1, which has been electrolytically degreased under the same conditions as those for the sample of the present invention No. 1, was pickled in an electrolyte containing 5 g/l sulfuric acid and then water-rinsed. The cold-rolled steel sheet thus electrolytically degreased and then pickled was subjected to a cathodic electrolytic chromate treatment under conditions shown in (A) below, and then subjected to an anodic electrolytic treatment under conditions shown in (B) below. Subsequently the thus treated cold-rolled steel sheet was subjected again to another cathodic electrolytic chromate treatment under the conditions shown in (A) below, water-rinsed and dried to prepare the sample for comparison No. 3 outside the scope of the present invention.

(A) Cathodic electrolytic chromate treatment conditions

| | |
|---|---|
| (1) Method for electrolysis | one-step method, |
| (2) Composition of electrolyte | |
| Chromic anhydride | 175 g/l, |
| Sodium silicofluoride | 5 g/l, |
| sodium sulfate | 0.9 g/l, |
| (3) Temperature of electrolyte | 40° C., |
| (4) Number of runs of electrolysis | 2 runs, |
| (5) Electric current density | 40 A/dm$^2$, |
| (6) Electrolytic treatment time per runs, | 0.3 seconds, |
| (7) Non-energizing time | 0.3 seconds. |

(B) Anodic electrolytic treatment conditions

| | |
|---|---|
| (1) Composition of electrolyte | |
| Chromic anhydride | 175 g/l, |
| Sodium silicofluoride | 5 g/l, |
| Sodium sulfate | 0.9 g/l, |
| (2) Temperature of electrolyte | 40° C., |
| (3) Electric current density | 4 A/dm$^2$ |
| (4) Electrolytic treatment time | 0.3 seconds. |

IV. Samples for comparison Nos. 4 to 8

Samples for comparison Nos. 4 to 8 outside the scope of the present invention were prepared under the same conditions as the respective ones for the samples of the present invention Nos. 4 to 8, except that cold-rolled steel sheets were not subjected to an anodic electrolytic treatment and that the cold-rolled steel sheets were subjected to a pickling treatment in an electrolyte containing 5 g/l sulfuric acid prior to application of a cathodic electrolytic chromate treatment.

An electrolytic precipitation efficiency of the metallic chromium layer, formation of the granular projections and a surface hue were evaluated as described below for each of the samples of the present invention Nos. 1 to 9 and the samples for comparison Nos. 1 to 8 prepared as described above. The results of evaluation is shown in Table 1.

(1) Electrolytic precipitation efficiency of metallic chromium layer

A precipitation weight of metallic chromium of the chromate film was measured for each of the samples of the present invention Nos. 1 to 9 and the samples for comparison Nos. 1 to 8, and an electrolytic precipitation efficiency of the metallic chromium layer for each of these samples was calculated from the measured precipitation weight of metallic chromium and the quantity of electricity required for the cathodic electrolytic chromate treatment.

(2) Formation of granular projections

For each of the samples of the present invention Nos. 1 to 9 and the samples for comparison Nos. 1 to 8, the metallic chromium layer of the chromate film was peeled off. The metallic chromium layer thus peeled off was subjected to electron-microscopic observation to investigate the state of formation of the granular projections on the metallic chromium layer for evaluation. The criteria for evaluation were as follows:

◎ : Numerous granular projections are very densely formed over the entire surface of the metallic chromium layer;

○ : Numerous granular projections are formed over the entire surface of the metallic chromium layer;

Δ : Granular projections are locally formed on the surface of the metallic chromium layer;

x : Almost no granular projections are formed on the surface of the metallic chromium layer.

(3) Surface hue

For each of the samples of the present invention Nos. 1 to 9 and the samples for comparison Nos. 1 to 8, the surface hue was visually inspected for evaluation. The criteria for evaluation were as follows:

○ : The surface of the sample never looks black or brown with a satisfactory surface hue;

x : The surface of the sample looks black or brown with a poor surface hue.

(4) Comprehensive evaluation:

○ : Good

Δ : Fair x : Poor.

TABLE 1

| No. | Precipitation efficiency of metallic chromium layer (%) | Formation of granular projections | Surface hue | Comprehensive evaluation |
|---|---|---|---|---|
| Sample of the present invention | | | | |
| 1 | 24.1 | ◎ | ○ | ○ |
| 2 | 25.2 | ◎ | ○ | ○ |
| 3 | 23.9 | ◎ | ○ | ○ |
| 4 | 24.2 | ○ | ○ | ○ |
| 5 | 23.6 | ◎ | ○ | ○ |
| 6 | 25.0 | ○ | ○ | ○ |
| 7 | 25.1 | ◎ | ○ | ○ |
| 8 | 24.2 | ○ | ○ | ○ |
| 9 | 25.1 | ◎ | ○ | ○ |
| Sample for comparison | | | | |
| 1 | 19.2 | Δ | ○ | Δ |
| 2 | 21.1 | Δ | ○ | Δ |
| 3 | 18.9 | ◎ | x | Δ |
| 4 | 19.0 | x | ○ | x |
| 5 | 19.0 | Δ | ○ | Δ |
| 6 | 19.2 | x | ○ | x |
| 7 | 18.3 | Δ | ○ | Δ |
| 8 | 19.6 | x | ○ | x |

As is clear from Table 1, in the samples for comparison Nos. 1 and 4 to 8, in which cold-rolled steel sheets were not subjected to an anodic electrolytic treatment and the cold-rolled steel sheets were subjected to a pickling treatment in an electrolyte containing sulfuric acid prior to application of a cathodic electrolytic chromate treatment, the granular projections are formed only locally on the surface of the metallic chromium layer, or almost no granular projections are formed. In the sample for comparison No. 2, in which a cold-rolled steel sheet was not subjected to an anodic electrolytic treatment and the cold-rolled steel sheet was immersed for a prescribed period of time into a solution containing chromic anhydride and sulfuric acid prior to application of a cathodic electrolytic chromate treatment, the granular projections are formed only locally on the surface of the metallic chromium layer. In the sample for comparison No. 3, in which a cold-rolled steel sheet was subjected to a pickling treatment in an electrolyte containing sulfuric acid prior to application of a cathodic electrolytic chromate treatment and the cold-rolled steel sheet was subjected to the anodic electrolytic treatment in the middle of the plurality of runs of application of the cathodic electric chromate treatment, the surface hue thereof is poor. In addition, in the samples for comparison Nos. 1 and 3 to 8, the electrolytic precipitation efficiency of the metallic chromium layer is low as under 20% in all cases.

In the samples of the present invention Nos. 1 to 9, in contrast, numerous granular projections are densely formed over the entire surface of the metallic chromium layer, with a satisfactory surface hue, and an electrolytic precipitation efficiency of the metallic chromium layer is high as over 23 % in all cases.

Figure 2:
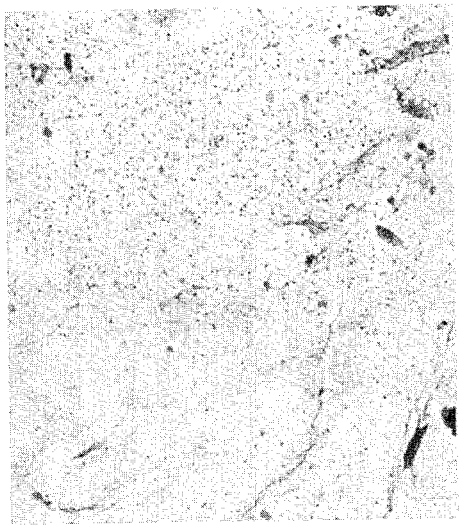
FIG. 2 is an electron micrograph (10,000 magnifications) illustrating the structure of the metallic chromium layer of the chromate film in the sample for comparison No. 1 outside the scope of the present invention, prepared in accordance with the conventional method.

FIG. 1 is an electron micrograph (10,000 magnifications) illustrating the structure of the metallic chromium layer of the chromating film in the sample of the present invention No. 1 prepared in accordance with the method of the present invention; and FIG. 2 is an electron micrograph (10,000 magnifications) illustrating the structure of the metallic chromium layer of the chromating film in the sample for comparison No. 1 outside the scope of the present invention, prepared in accordance with the conventional method. As is evident from FIGS. 1 and 2, the granular projections formed on the surface of the metallic chromium layer in the sample of the present invention No. 1 are dense and have a larger particle size than the granular projections formed on the surface of the metallic chromium layer in the sample for comparison No. 1.

According to the method of the present invention, as described above in detail, it is possible to efficiently manufacture an electrolytically chromated steel sheet excellent in a secondary paint adhesion and a weldability and having a satisfactory surface hue, thus providing industrially useful effects.

What is claimed is:

1. A method for manufacturing an electrolytically chromated steel sheet, comprising the steps of:

anodically treating a steel sheet at a current density of from 0.3 to 20 coulomb/dm$^2$ in an acidic aqueous electrolyte containing at least one of chromic anhydride, chromate and bichromate, to form a hydrated chromium oxide film having numerous holes and numerous thin portions over the entire area of at least one surface of said steel sheet; and then cathodically treating said anodically treated steel sheet in an acidic aqueous electrolytic chromating solution to form on said at least one surface of said steel sheet a chromate film comprising a metallic chromium layer as a lower layer having thereon numerous granular projections corresponding to said numerous holes and said numerous thin portions, and a hydrated chromium oxide layer as an upper layer formed on said metallic chromium layer.

2. The method as claimed in claim 1, wherein:

said acidic electrolyte for said anodic electrolytic treatment further additionally contains at least one of sulfuric acid ion and fluorine ion in an amount within the range of from 0.1 to 5 wt. % relative to chromium in said acidic electrolyte.

3. The method as claimed in claim 2, wherein said numerous granular projections have an average particle size of about 0.1 μm.

* * * * *

UNITED STATES PATENT AND TRADEMARK OFFICE

CERTIFICATE OF CORRECTION

PATENT NO. : 4,875,984

DATED : October 24, 1989

INVENTOR(S) : IWASA et al

It is certified that error appears in the above-identified patent and that said Letters Patent is hereby corrected as shown below:

Column 16, lines 52 and 53 (Claim 1): replace "at a current density of from 0.3 to 20 coulomb/$dm^2$" with --with a quantity of electricity of from 0.3 to 30 coulomb/$dm^2$--.

Signed and Sealed this

Twenty-first Day of January, 1992

*Attest:*

HARRY F. MANBECK, JR.

*Attesting Officer*

*Commissioner of Patents and Trademarks*